US006747604B2

(12) United States Patent
Amyotte et al.

(10) Patent No.: US 6,747,604 B2
(45) Date of Patent: Jun. 8, 2004

(54) STEERABLE OFFSET ANTENNA WITH FIXED FEED SOURCE

(75) Inventors: Éric Amyotte, Laval (CA); Martin Gimersky, Montreal (CA); Yves Gaudette, St-Lazare (CA); Luis Martins-Camelo, Bainsville (CA); Marc Donato, Pointe-Claire (CA)

(73) Assignee: EMS Technologies Canada, Inc., Montreal (CA)

( * ) Notice: Subject to any disclaimer, the term of this patent is extended or adjusted under 35 U.S.C. 154(b) by 0 days.

(21) Appl. No.: 10/265,600

(22) Filed: Oct. 8, 2002

(65) Prior Publication Data

US 2004/0066344 A1 Apr. 8, 2004

(51) Int. Cl.[7] ..... H01Q 19/06
(52) U.S. Cl. ..... 343/754; 343/757; 343/761
(58) Field of Search ..... 343/754, 755, 343/757, 761, 763, 765, 766

(56) References Cited

U.S. PATENT DOCUMENTS 3,848,255 A 11/1974 Migdal
4,772,892 A 9/1988 Payelian et al.
5,194,874 A * 3/1993 Perrotta ..... 343/757
5,485,168 A * 1/1996 Parekh ..... 343/761
5,684,494 A 11/1997 Natharath et al.
5,844,527 A * 12/1998 Takashima et al. ..... 343/781 P
6,043,788 A 3/2000 Seavey
6,191,744 B1 * 2/2001 Snow et al. ..... 343/703
6,262,689 B1 7/2001 Yamamoto et al.
6,492,955 B1 * 12/2002 Amyotte et al. ..... 343/781 P

* cited by examiner

*Primary Examiner*—Tan Ho
(74) *Attorney, Agent, or Firm*—Holland & Knight LLP

(57) ABSTRACT

A steerable antenna allows transmission of an electromagnetic signal between a fixed feed source or an image thereof and a target moving within an antenna coverage region. The peak gain of the signal beam varies as a function of the target position following a desired signal gain profile. The antenna includes a reflector defining a reflector surface for reflecting the signal between the feed source or its image and the target. The reflector surface defines a focal point, a center point and a normal axis perpendicular to the reflector surface at the center point. The normal axis and the feed axis intersecting the center point and the feed source or its image define a common offset plane. An elevation rotary actuator rotates the reflector about a rotation axis perpendicular to the offset plane adjacent to the center point so that the antenna provides a nominal signal gain profile over the coverage region. The reflector is shaped to alter the nominal gain profile so that the latter matches the desired gain profile. Preferably, an azimuth rotary actuator rotates the antenna about the feed axis.

21 Claims, 4 Drawing Sheets

STEERABLE OFFSET ANTENNA WITH FIXED FEED SOURCE

FIELD OF THE INVENTION

The present invention relates to the field of antennas and is more particularly concerned with steerable offset antennas for transmitting and/or receiving electromagnetic signals.

BACKGROUND OF THE INVENTION

It is well known in the art to use steerable (or tracking) antennas to communicate with a relatively moving target. Especially in the aerospace industry, such steerable antennas preferably need to have high gain, low mass, and high reliability. One way to achieve such an antenna system is to provide a fixed feed source, thereby eliminating performance degradations otherwise associated with a moving feed source. These degradations include losses due to mechanical rotary joints, flexible waveguides, long-length RF cables associated with cable wrap units mounted on rotary actuators, or the like.

U.S. Pat. No. 6,043,788 granted on Mar. 28, 2000 to Seavey discloses a tracking antenna system that is substantially heavy and includes a large quantity of moving components that reduce the overall reliability of the system. Also, the steering angle range of the system is limited by the fixed angle between the boresite of the offset paraboloidal reflector and the kappa axis determined by the distance between the offset ellipsoidal subreflector and the offset paraboloidal reflector; a wide steering angle range requiring a large distance there between, resulting in a large antenna system that would not be practical especially for spaceborne applications.

Furthermore, especially for LEO (Low Earth Orbit) satellite application where microwave band signals or the like are used, the smaller the elevation angle above horizontal is, the larger the signal loss and/or attenuation due to the normal atmosphere and rainfalls is. This is mainly due to the distance the signal travels there through. Accordingly, it is preferable to have a higher antenna gain at low elevation angle to compensate therefore, as disclosed in U.S. Pat. No. 6,262,689 granted to Yamamoto et al. on Jul. 17, 2001.

Although such a configuration provides for a variable antenna gain profile over the elevation angle range, between the lowest elevation angle and the maximum angle of ninety (90) degrees, at which point the antenna reflected signal substantially points at the zenith when the antenna is used on a ground station or at nadir when the antenna is on the earth facing panel of a spacecraft, it does not allow for the antenna gain to follow a desired predetermined signal gain profile. Thus imposing an antenna signal gain higher than really required over a significant portion of the elevation angle range as well as a lower signal gain there across than really required over another significant portion of the elevation angle range.

SUMMARY OF THE INVENTION

It is therefore a general object of the present invention to provide a steerable offset antenna with a fixed feed source.

An advantage of the present invention is that the steerable offset antenna eliminates the signal losses associated with conventional rotary joints and long flexible coaxial cables.

Another advantage of the present invention is that the steerable offset antenna has an antenna reflected signal coverage region spanning over a conical angle with minimum blockage from its own structure, whenever allowed by the supporting platform.

A further advantage of the present invention is that the steerable offset antenna provides a high gain and/or an excellent polarization purity.

Still another advantage of the present invention is that the steerable offset antenna has simple actuation devices as well as convenient locations thereof.

Another advantage of the present invention is that the steerable offset antenna provides for a predetermined or desired signal gain profile over the antenna reflected signal coverage region, preferably providing a substantially uniform signal to the target wherever its position within the coverage region.

A further advantage of the present invention is that the steerable offset antenna can be mounted on either an orbiting spacecraft or a fixed station and track a ground station or an orbiting spacecraft respectively, or be mounted on a spacecraft and track another spacecraft.

According to an aspect of the present invention, there is provided a steerable antenna for allowing transmission of an electromagnetic signal between a fixed feed source or image thereof and a target moving within an antenna coverage region, the electromagnetic signal having a gain varying with the position of the target within the coverage region according to a predetermined signal gain profile thereacross, the coverage region defining a region peripheral edge, the antenna comprises a reflector defining a reflector surface for reflecting the electromagnetic signal between the feed source or image thereof and the target, the reflector surface defining a focal point, a reflector center point and a reflector normal axis substantially perpendicular to the reflector surface at the reflector center point, the reflector center point and the focal point being spaced relative to each other by a focal point-to-center point distance, the reflector center point and the feed source or image thereof being spaced relative to each other by a feed-to-center point distance along a feed axis, the feed-to-center point distance being substantially equal to the focal point-to-center point distance, the reflector normal axis and the feed axis defining a common offset plane; a first rotating means for rotating the reflector about a rotation axis extending generally perpendicularly from the offset plane in a position generally adjacent the reflector center point so that the antenna provides a nominal signal gain profile over the coverage region, the reflector defining a reference position wherein the focal point substantially intersects the feed axis and corresponding to a nominal signal gain being substantially maximum with the electromagnetic signal substantially pointing at the region peripheral edge; and a gain altering means for altering the nominal signal gain profile so that the latter matches the predetermined signal gain profile; whereby the reflector in combination with the gain altering means are rotatable about the rotation axis so as to steer the electromagnetic signal according to the predetermined signal gain profile at the target moving across the coverage region.

Typically, the reflector surface is shaped to alter the nominal signal gain profile so that the latter matches the predetermined signal gain profile, the shaped reflector surface being the gain altering means.

In one embodiment, the reflector is rotatable about the rotation axis between a first limit position wherein the reflector normal axis is substantially collinear with the feed axis and a second limit position corresponding to the reference position; whereby the reflector surface allows transmission of the electromagnetic signal between the feed source or image thereof and the target; the reflector being pivoted about the rotation axis between the first and second limit positions so that the reflected electromagnetic signal, when pointing at the target, defines the coverage region with a generally sectorial configuration.

Typically, the antenna further includes a second rotating means for rotating the reflector about the feed axis, the reflector being rotatable between a first azimuth position and a second azimuth position; whereby the reflector is pivoted about the rotation axis between the first and second limit positions and about the feed axis between the first and second azimuth positions so that the reflected electromagnetic signal, when pointing at the target, defines the coverage region with a generally partially conical configuration and the region peripheral edge with a generally arc-shaped line configuration.

According to another aspect of the present invention, there is provided a method for transmitting an electromagnetic signal between a fixed feed source or image thereof and a target moving within an antenna coverage region, the electromagnetic signal having a gain varying with the position of the target within the coverage region according to a predetermined signal gain profile thereacross, the coverage region defining a region peripheral edge, the method comprises the steps of positioning a reflector relative to the feed source or image thereof for reflecting the electromagnetic signal between the feed source or image thereof and the target, the reflector defining a reflector surface, the reflector surface defining a focal point, a reflector center point and a reflector normal axis substantially perpendicular to the reflector surface at the reflector center point, the reflector center point and the focal point being spaced relative to each other by a focal point-to-center point distance, the reflector center point and the feed source or image thereof being spaced relative to each other by a feed-to-center point distance along a feed axis, the feed-to-center point distance being substantially equal to the focal point-to-center point distance, the reflector normal axis and the feed axis defining a common offset plane; rotating the reflector about a rotation axis extending generally perpendicularly from the offset plane in a position generally adjacent the reflector center point so that the antenna provides a nominal signal gain profile over the coverage region, the reflector defining a reference position wherein the focal point substantially intersects the feed axis and corresponding to a nominal signal gain being substantially maximum with the electromagnetic signal substantially pointing at the region peripheral edge; and altering the nominal signal gain profile so that the latter matches the predetermined signal gain profile; whereby the reflector in combination with the gain altering means are rotatable about the rotation axis so as to steer the electromagnetic signal according to the predetermined signal gain profile at the target moving across the coverage region.

Typically, the method further includes the step of rotating the reflector about the feed axis, the reflector being rotatable between a first azimuth position and a second azimuth position; whereby the reflector is pivoted about the rotation axis and about the feed axis between the first and second azimuth positions so that the reflected electromagnetic signal, when pointing at the target, defines the coverage region with a generally partially conical configuration and the region peripheral edge with a generally arc-shaped line configuration.

Other objects and advantages of the present invention will become apparent from a careful reading of the detailed description provided herein, with appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
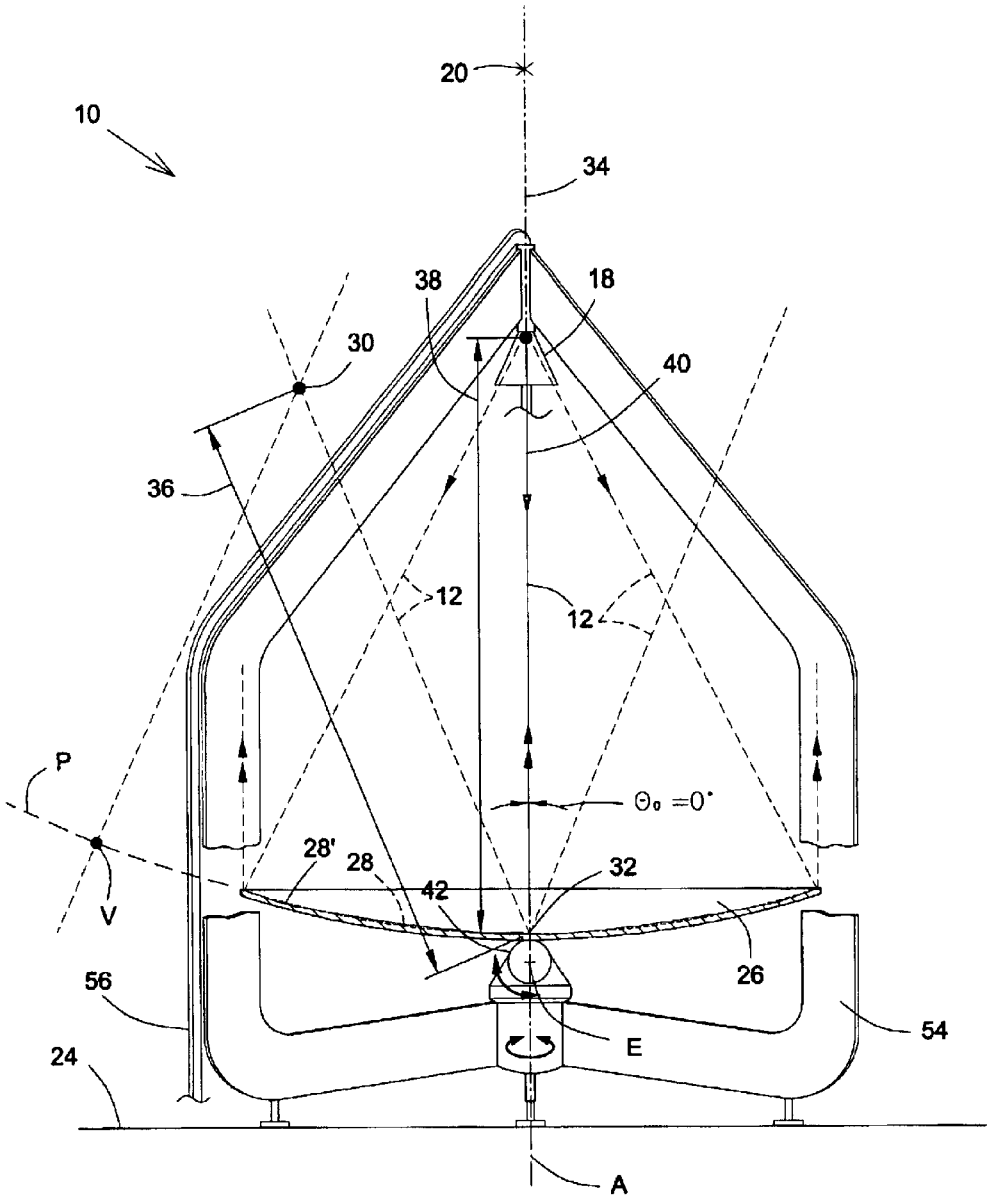
FIG. 1 is a partially broken side section view, showing a steerable antenna in accordance with an embodiment of the present invention pointing in the nadir direction.
Figure 2:
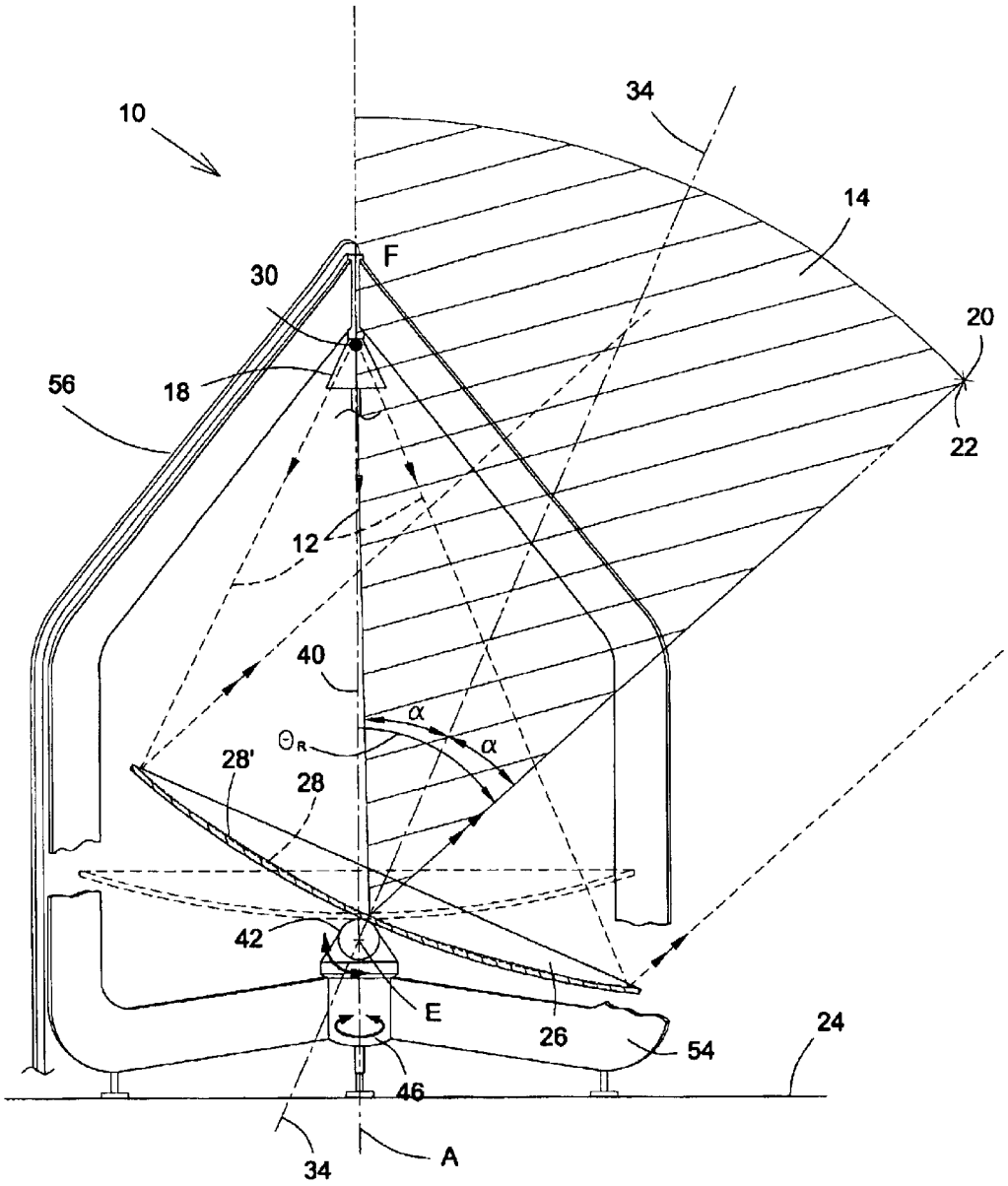
FIG. 2 is a view similar to FIG. 1, showing the steerable antenna in a nominal configuration with the reflected signal pointing at its lowest elevation angle (widest scan angle from nadir)

Referring to FIGS. 1 and 2, there is shown a steerable antenna 10 for allowing transmission and/or reception of an electromagnetic signal 12 within an antenna coverage region 14 with a predetermined or desired signal gain profile 16 over the coverage region 14. The electromagnetic signal 12 travels between a feed source 18 (or its image) and a target 20 moving within the coverage region 14. The peak gain of the signal beam varies as a function of the target 20 position, following a predetermined profile 16. The feed source 18 is either generally fixed or provides a fixed feed source image relative to the spacecraft (for a spacecraft mounted antenna) or the ground (for a ground-station antenna) during rotation of the antenna 10. The coverage region 14 defines a region peripheral edge 22, shown as a point in FIG. 2, at which the nominal antenna gain is often set to be at its maximum.

Although the antenna 10 described hereinafter is mounted on the earth facing panel 24 or deck of a satellite pointing at the Earth surface (not shown) with the target 20 being a specific location thereon, it should be understood that any other configuration of a similar antenna such as a ground antenna facing at orbiting satellites could be considered without departing from the scope of the present invention.

The antenna 10 generally includes a reflector 26. The latter defines a nominal reflector surface 28 for reflecting the electromagnetic signal 12 between the fixed feed source or an image thereof 18, shown as the feed source 18 itself in FIGS. 1 and 2, and the target 20. The nominal reflector surface 28 defines a focal point 30, a reflector center point 32 and a reflector normal axis 34 substantially perpendicular to the nominal reflector surface 28 at the reflector center point 32. The portion of the electromagnetic signal 12 reaching the reflector center point 32 is reflected about the reflector normal axis 34, as represented by angles $\alpha$ in FIG. 2; similarly for each point of the nominal reflector surface 28 having its corresponding normal axis. The reflector center point 32 and the focal point 30 are spaced relative to each other by a focal point-to-center point distance 36. The reflector center point 32 and the feed source 18 (or image thereof) are spaced relative to each other by a feed-to-center point distance 38 along a feed axis 40. The feed-to-center point distance 38 is substantially equal to the focal point-to-center point distance 36. The reflector normal axis 34 and the feed axis 40 define a common offset plane, represented by the plane of the sheet on which FIG. 1 is drawn.

A first rotating means, preferably an elevation rotary actuator 42, rotates the reflector 26 about a rotation axis E, or elevation axis, extending generally perpendicularly from the offset plane in a position intersecting the offset plane in the vicinity of the reflector center point 32 so that the antenna 10 provides a nominal signal gain profile 44 over the coverage region 14. Preferably, the elevation actuator 42 rotates the reflector 26 about the elevation axis E between a first limit position wherein the reflector normal axis 34 is substantially collinear with the feed axis 40 and corresponding to a first reflected signal limit position $\theta_O$ at nadir position ($\theta$=0°) and a second limit position wherein the focal point 30 substantially intersects the feed axis 40 and corresponding to a reference position in which the reflected electromagnetic signal 12 is at a second reflected signal limit position $\theta_R$ and substantially points at the region peripheral edge 22, as generally illustrated in FIG. 2. Generally, the reference position $\theta_R$ corresponds to a nominal signal gain that is substantially maximum.

Accordingly, when the reflector 26 is pivoted about the elevation axis E so as to scan the reflected signal between the first $\theta_O$ and second $\theta_R$ limit positions, the reflected signal to the target 20 defines a coverage region 14 having a generally sectorial configuration, as illustrated in FIG. 2. Since the reflector normal axis 34 rotates relative to the feed axis 40 upon activation of the elevation rotary actuator 42, the antenna effective scan angle increases and the reflected signal to the target 20 rotates approximately twice as fast as the reflector 26 relative to the feed axis 40.

Typically, the nominal reflector surface 28 is a section of a conical function surface, preferably a parabola P, or a parabolic surface, shown in dashed lines in FIG. 1. The parabola P defines one vertex V thereof, the vertex V being related to the focal point 30.

Preferably, the vertex V is spaced apart from the offset parabolic surface 28 to substantially align the center 32 of the reflector 26 with the feed axis 40 thus allowing for an efficient reflector illumination by the feed source 18 (or its image) so as to provide a substantially uniform signal density, or isoflux, across the entire coverage region 14.

The antenna 10 further includes a gain altering means to alter the nominal signal gain profile 44 so that the latter matches the predetermined signal gain profile 16, whereby the altered reflector (reflector in combination with the gain altering means) is rotated about the elevation axis E so as to steer the electromagnetic signal 12 according to the predetermined signal gain profile 16 at the target 20 moving along the coverage region 14.

Typically, as the gain altering means, the nominal reflector surface 28 is shaped into a shaped reflector surface 28' to alter the nominal signal gain profile 44 so that the latter matches the predetermined signal gain profile 16. The shaped reflector surface 28' is generally configured and sized, preferably using a Zernike polynomial expansion or a like selection of basis functions, so as to control the signal gain degradation of the predetermined signal gain profile 16, upon rotation of the reflector 26 about the elevation axis E, to scan the reflected signal from $\theta_R$ to $\theta_O$.

Typically, the antenna 10 further includes a second rotating means, preferably an azimuth rotary actuator 46, that rotates the reflector 26 about the feed axis 40, or azimuth axis A, between a first azimuth position $\phi_1$ and a second azimuth position $\phi_2$; whereby the coverage region 14 therefore has a generally partially conical configuration, with the region peripheral edge 22 having a generally arc-shaped line configuration.

Figure 3:
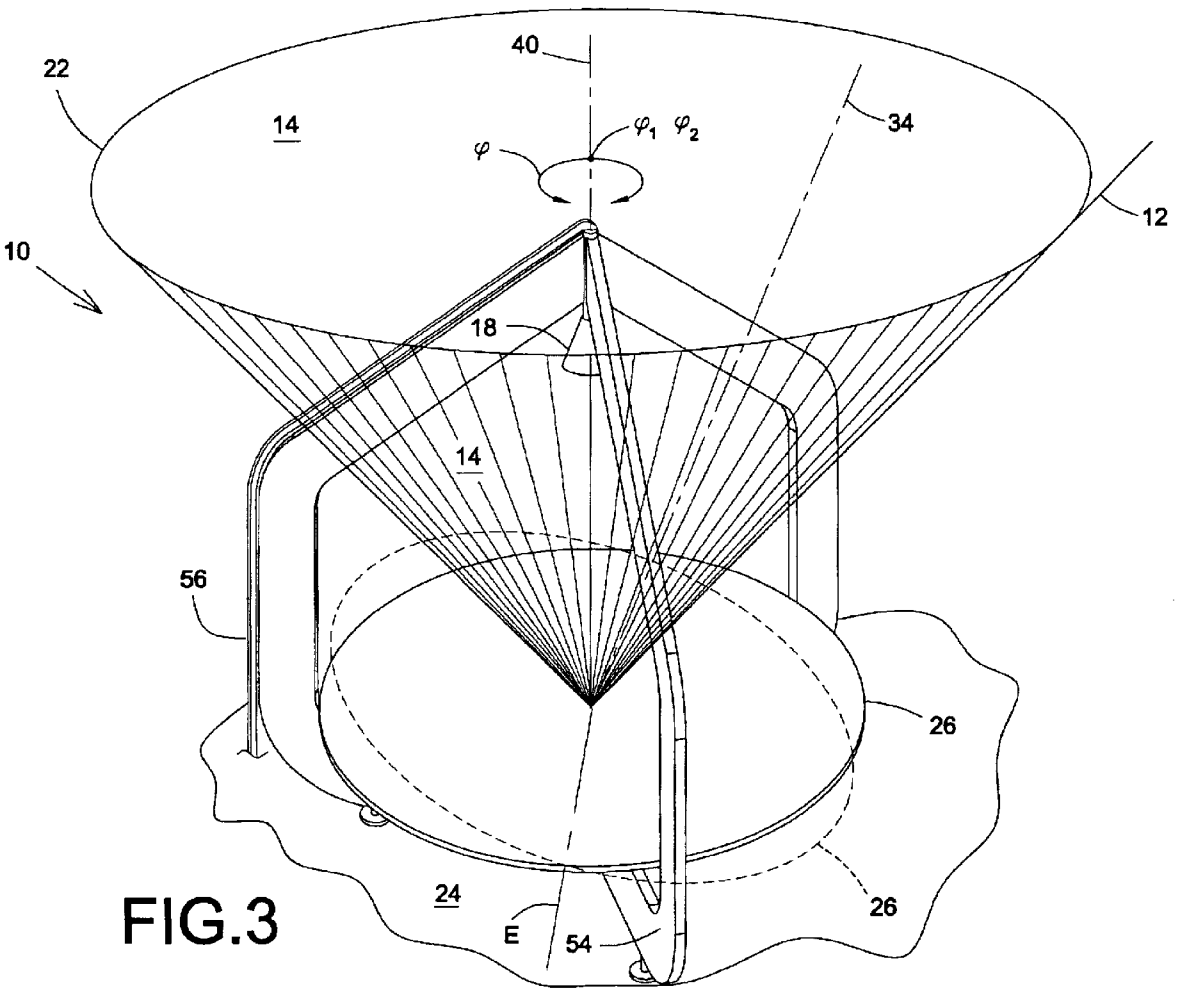
FIG. 3 is a top perspective view, showing the antenna reflected signal coverage region of the embodiment of FIG. 1.

Preferably, the second azimuth position $\phi_2$ is generally 360 degrees, or a complete revolution, apart from the first azimuth position $\phi_1$ so that the reflected signal to the target 20 defines a coverage region 14 with a generally conical configuration and the region peripheral edge 22 with a generally circular configuration, as shown in FIG. 3.

Figure 4:
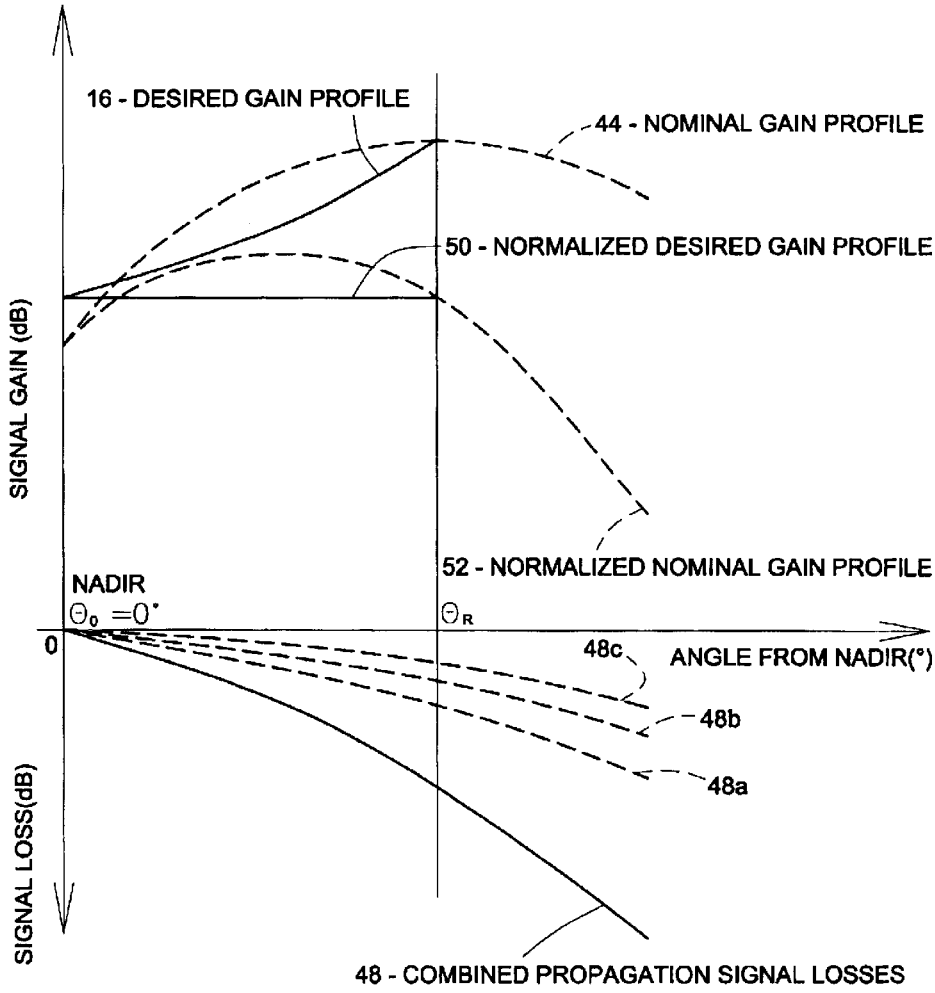
FIG. 4 is a schematic representation of the relationship between the predetermined signal gain profile, the nominal signal gain profile, the combined losses and the antenna elevation angle.

As graphically shown in FIG. 4, when the antenna 10 is mounted on the earth facing panel 24 of the spacecraft so that the reflector 26 points at the earth surface (not shown), the combined propagation signal losses 48 increase as the signal scan angle $\theta$ increases. The combined propagation signal losses 48 include typical signal losses or attenuation due to the path 48*a*, the rain 48*b*, the atmosphere 48*c* and the like when considering the wavelength or frequency of the signal 12. The predetermined signal gain profile 16 is generally set to obtain as much as possible a uniform normalized shaped antenna gain 50 over the entire antenna coverage region 14, between the first $\theta_O$ and second $\theta_R$ limit positions, with the combined propagation signal losses 48 taken into account so as to provide a uniform antenna coverage, wherever the target 20 may be on the earth surface within the antenna coverage region 14, with a relatively high minimum signal gain.

On the other hand, the normalized nominal antenna gain 52 obtained with the nominal reflector surface 28 is non-uniform over the antenna coverage region 14. In order to obtain a similar minimum signal gain with a nominal reflector surface 28, the size of the latter would need to be relatively larger, which is usually not desired especially in spacecraft applications. Although not shown herein, it is to be understood that any non-uniform normalized desired signal gain profile 50 could be achieved by proper shaping of the shaped reflector surface 28' leading to a desired signal gain profile 16 without departing from the scope of the present invention.

The present invention also includes a method for transmitting an electromagnetic signal 12 within an antenna coverage region 14 with a predetermined signal gain profile 16 thereover. The electromagnetic signal 12 travels between a feed source or image thereof 18 and a target 20. The latter moves within the coverage region 14 that defines a region peripheral edge 22. The source 18 (or its image) remains fixed during mechanical rotation of the antenna 10.

The method includes the step of positioning a reflector 26 relative to the fixed feed source 18 (or its image) to reflect the electromagnetic signal 12 between the feed source 18 (or its image) and the target 20.

Then the reflector 26 is rotated about a rotation axis E extending generally perpendicularly from the offset plane in a position generally adjacent the reflector center point 32 so that the antenna 10 provides a nominal signal gain profile 44 over the coverage region 14.

Then the method includes altering the nominal signal gain profile 44 so that the latter matches the predetermined signal gain profile 16; whereby the altered reflector 26 is rotated about the rotation axis so as to steer the electromagnetic signal 12 according to the predetermined signal gain profile 16 at the target 20 that moves within the antenna coverage region 14.

Altering the nominal signal gain profile 44 includes shaping the reflector surface 28 so that the nominal signal gain profile 44 matches the predetermined signal gain profile 16. Preferably, the reflector surface 28' is configured and sized, preferably using a Zernike polynomial expansion or a like selection of basis functions, so as to control the signal gain degradation of the predetermined signal gain profile 16 upon rotation of the reflector 26 about the elevation axis E, so as to scan the reflected signal from $\theta_R$ to $\theta_O$.

Typically, the method includes the step of rotating the reflector about the feed axis 40, or azimuth axis, between a first azimuth position $\phi_1$ and a second azimuth position $\phi_2$, preferably 360 degrees apart from each other as illustrated in FIG. 3, so that the coverage region 14 therefore has a generally conical configuration.

Although not required, the fixed feed source 18 and the elevation and azimuth actuators 42, 46 are preferably mounted on a common support structure 54 secured to the earth facing panel 24, the feed source 18 being preferably fed by a conventional signal waveguide 56 or fixed low-loss coaxial cable also supported by the structure 54. As commonly known in telecommunication industry, the support structure 54 is generally configured and sized so as to minimize its impact on the performance of the antenna 10, especially when the signal frequency is high.

Although not described hereinabove, encoders or the like are preferably used for providing feedback on the angular positions of both elevation and azimuth actuators 42, 46, respectively.

Also, although a parabolic conical function P is described hereinabove and shown throughout the figures, is should be understood that well known elliptical as well as hyperbolic conical functions could be similarly considered without departing from the scope of the present invention.

Throughout FIGS. 1 to 3, the feed source 18 is shown as being fixed relative to the reflector 26 in a position so as to generally be at the focal point 30 of the reflector 26 when the reflected signal (and the reflector 26 in this specific position) is pointing in the nadir direction ($\theta$=0°). Alternatively, the image of the feed source could be at that same location while the feed source itself would be located elsewhere.

Accordingly, the feed source 18 could point at a sub-reflector (not shown) reflecting the signal to the reflector 26. In such a configuration, the sub-reflector would have either a hyperbolic or an ellipsoidal shape with the feed source 18 located at the first focal point thereof and the image of the feed source located at the second focal point thereof, which would coincide with the position of the feed source 18 as shown in FIGS. 1 to 3, thereby forming a conventional Cassegrainian or Gregorian type antenna, respectively. Obviously, a planar sub-reflector can also be used to generate the feed image.

Although the steerable offset antenna has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A steerable antenna for allowing transmission of an electromagnetic signal between a fixed feed source or image thereof and a target moving within an antenna coverage region, said electromagnetic signal having a gain varying with the position of said target within said coverage region according to a predetermined signal gain profile thereacross, said coverage region defining a region peripheral edge, said antenna comprising:

a reflector defining a reflector surface for reflecting said electromagnetic signal between said feed source or image thereof and said target, said reflector surface defining a focal point, a reflector center point and a reflector normal axis substantially perpendicular to said reflector surface at said reflector center point, said reflector center point and said focal point being spaced relative to each other by a focal point-to-center point distance, said reflector center point and said feed source or image thereof being spaced relative to each other by a feed-to-center point distance along a feed axis, said feed-to-center point distance being substantially equal to said focal point-to-center point distance, said reflector normal axis and said feed axis defining a common offset plane;

a first rotating means for rotating said reflector about a rotation axis extending generally perpendicularly from said offset plane in a position generally adjacent said reflector center point so that said antenna provides a nominal signal gain profile over said coverage region, said reflector defining a reference position wherein said focal point substantially intersects said feed axis and corresponding to a nominal signal gain being substantially maximum with said electromagnetic signal substantially pointing at said region peripheral edge; and a gain altering means for altering said nominal signal gain profile so that the latter matches said predetermined signal gain profile; whereby said reflector in combination with said gain altering means are rotatable about said rotation axis so as to steer said electromagnetic signal according to said predetermined signal gain profile at said target moving across said coverage region.

2. The antenna defined in claim 1 wherein said reflector surface is shaped to alter said nominal signal gain profile so that the latter matches said predetermined signal gain profile, said shaped reflector surface being said gain altering means.

3. The antenna defined in claim 2 wherein said reflector surface is configured and sized so as to control the signal gain of said predetermined signal gain profile upon rotation of said reflector about said rotation axis.

4. The antenna defined in claim 1 further including a second rotating means for rotating said reflector about said feed axis, said reflector being rotatable between a first azimuth position and a second azimuth position; whereby said reflector is pivoted about said rotation axis and about said feed axis between said first and second azimuth positions so that the reflected electromagnetic signal, when pointing at said target, defines said coverage region with a generally partially conical configuration and said region peripheral edge with a generally arc-shaped line configuration.

5. The antenna defined in claim 1 wherein said reflector is rotatable about said rotation axis between a first limit position wherein said reflector normal axis is substantially collinear with said feed axis and a second limit position corresponding to said reference position; whereby said reflector surface allows transmission of said electromagnetic signal between said feed source or image thereof and said target; said reflector being pivoted about said rotation axis between said first and second limit positions so that the reflected electromagnetic signal, when pointing at said target, defines said coverage region with a generally sectorial configuration.

6. The antenna defined in claim 5 further including a second rotating means for rotating said reflector about said feed axis, said reflector being rotatable between a first azimuth position and a second azimuth position; whereby said reflector is pivoted about said rotation axis between said first and second limit positions and about said feed axis between said first and second azimuth positions so that the reflected electromagnetic signal, when pointing at said target, defines said coverage region with a generally partially conical configuration and said region peripheral edge with a generally arc-shaped line configuration.

7. The antenna defined in claim 6 wherein said second azimuth position is generally 360 degrees apart from said first azimuth position so that the reflected electromagnetic signal, when pointing at said target, defines said coverage region with a generally conical configuration and said region peripheral edge with a generally circular configuration.

8. The antenna defined in claim 1 wherein said reflector surface is a section of a conical function surface, said conical function surface defining at least one vertex thereof, said vertex being related to said focal point.

9. The antenna defined in claim 8 wherein said at least one vertex is spaced apart from said section of said conical function surface; whereby said antenna allows for an efficient illumination of said reflector by said feed source or image thereof.

10. The antenna defined in claim 9 wherein said conical function surface is a parabola, said reflector surface being an offset parabolic surface.

11. A method for transmitting an electromagnetic signal between a fixed feed source or image thereof and a target moving within an antenna coverage region, said electromagnetic signal having a gain varying with the position of said target within said coverage region according to a predetermined signal gain profile thereacross, said coverage region defining a region peripheral edge, said method comprising the steps of:

positioning a reflector relative to said feed source or image thereof for reflecting said electromagnetic signal between said feed source or image thereof and said target, said reflector defining a reflector surface, said reflector surface defining a focal point, a reflector center point and a reflector normal axis substantially perpendicular to said reflector surface at said reflector center point, said reflector center point and said focal point being spaced relative to each other by a focal point-to-center point distance, said reflector center point and said feed source or image thereof being spaced relative to each other by a feed-to-center point distance along a feed axis, said feed-to-center point distance being substantially equal to said focal point-to-center point distance, said reflector normal axis and said feed axis defining a common offset plane;

rotating said reflector about a rotation axis extending generally perpendicularly from said offset plane in a position generally adjacent said reflector center point so that said antenna provides a nominal signal gain profile over said coverage region, said reflector defining a reference position wherein said focal point substantially intersects said feed axis and corresponding to a nominal signal gain being substantially maximum with said electromagnetic signal substantially pointing at said region peripheral edge; and altering said nominal signal gain profile so that the latter matches said predetermined signal gain profile; whereby said reflector in combination with said gain altering means are rotatable about said rotation axis so as to steer said electromagnetic signal according to said predetermined signal gain profile at said target moving across said coverage region.

12. The method defined in claim 11 wherein the step of altering said nominal signal gain profile includes shaping said reflector surface so that said nominal signal gain profile matches said predetermined signal gain profile.

13. The method defined in claim 12 wherein the step of shaping said reflector surface includes configuring and sizing said reflector surface so as to control the signal gain of said predetermined signal gain profile upon rotation of said reflector about said rotation axis.

14. The method defined in claim 11 further including the step of:

rotating said reflector about said feed axis, said reflector being rotatable between a first azimuth position and a second azimuth position; whereby said reflector is pivoted about said rotation axis and about said feed axis between said first and second azimuth positions so that the reflected electromagnetic signal, when pointing at said target, defines said coverage region with a generally partially conical configuration and said region peripheral edge with a generally arc-shaped line configuration.

15. The method defined in claim 11, wherein the step of rotating said reflector includes rotating the latter about said rotation axis between a first limit position wherein said reflector normal axis is substantially collinear with said feed axis and a second limit position corresponding to said reference position; whereby said reflector surface allows transmission of said electromagnetic signal between said feed source or image thereof and said target; said reflector being pivoted about said rotation axis between said first and second limit positions so that the reflected electromagnetic signal, when pointing at said target, defines said coverage region with a generally sectorial configuration.

16. The method defined in claim 15 further including the step of:

rotating said reflector about said feed axis, said reflector being rotatable between a first azimuth position and a second azimuth position; whereby said reflector is pivoted about said rotation axis and about said feed axis between said first and second azimuth positions so that the reflected electromagnetic signal, when pointing at said target, defines said coverage region with a generally partially conical configuration and said region peripheral edge with a generally arc-shaped line configuration.

17. The method defined in claim 16 wherein said second azimuth position is generally 360 degrees apart from said first azimuth position so that the reflected electromagnetic signal, when pointing at said target, defines said coverage region with a generally conical configuration and said region peripheral edge with a generally circular configuration.

18. The method defined in claim 11, wherein said reflector surface is a section of a conical function surface, said conical function surface defining at least one vertex thereof, said vertex being related to said focal point.

19. The method defined in claim 18 wherein said at least one vertex is spaced apart from said section of said conical function surface; whereby said antenna allows for an efficient illumination of said reflector by said feed source or image thereof.

20. The method defined in claim 19 wherein said conical function surface is a parabola, said reflector surface being an offset parabolic surface.

21. A steerable antenna for allowing transmission of an electromagnetic signal between a fixed feed source and a target moving within an antenna coverage region, said electromagnetic signal having a gain varying with the position of said target within said coverage region according to a predetermined signal gain profile thereacross, said coverage region defining a region peripheral edge, said antenna comprising:

a reflector defining a reflector surface for reflecting said electromagnetic signal between said feed source and said target, said reflector surface defining a focal point, a reflector center point and a reflector normal axis substantially perpendicular to said reflector surface at said reflector center point, said reflector center point and said focal point being spaced relative to each other by a focal point-to-center point distance, said reflector center point and said feed source being spaced relative to each other by a feed-to-center point distance along a feed axis, said feed-to-center point distance being substantially equal to said focal point-to-center point distance, said reflector normal axis and said feed axis extending in a common offset plane;

a first rotating means for rotating said reflector about a rotation axis extending generally perpendicularly from said offset plane in a position generally adjacent said reflector center point so that said antenna provides a nominal signal gain profile over said coverage region, said reflector rotating about said rotation axis between a first limit position wherein said reflector normal axis is substantially collinear with said feed axis and a second limit position wherein said focal point substantially intersects said feed axis and corresponding to a nominal signal gain being substantially maximum with said electromagnetic signal substantially pointing at said region peripheral edge;

a gain altering means for altering said nominal signal gain profile so that the latter matches said predetermined signal gain profile; and a second rotating means for rotating said reflector about said feed axis, said reflector being rotatable between a first azimuth position and a second azimuth position, said second azimuth position is generally 360 degrees apart from said first azimuth position;

whereby said reflector in combination with said gain altering means are rotatable about said rotation axis between said first and second limit positions and about said feed axis between said first and second azimuth positions so as to steer said electromagnetic signal according to said predetermined signal gain profile at said target moving across said coverage region, so that the reflected electromagnetic signal, when pointing at said target, defines a coverage region having a generally conical configuration.

* * * * *